US008977162B2

(12) United States Patent
Kim et al.

(10) Patent No.: US 8,977,162 B2
(45) Date of Patent: Mar. 10, 2015

(54) DEVELOPING DEVICE AND IMAGE FORMING APPARATUS INCLUDING THE SAME

(71) Applicant: SAMSUNG Electronics Co., Ltd., Suwon-si, Gyeonggi-do (KR)

(72) Inventors: Jong-in Kim, Suwon-si (KR); Woong-yong Choi, Yongin-si (KR); Dong-uk Kim, Suwon-si (KR); Jong-hwa Joo, Seoul (KR)

(73) Assignee: SAMSUNG Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/681,670

(22) Filed: Nov. 20, 2012

(65) Prior Publication Data

US 2013/0129384 A1 May 23, 2013

(30) Foreign Application Priority Data

Nov. 22, 2011 (KR) ..... 10-2011-0122407

(51) Int. Cl.
*G03G 21/18* (2006.01)
*G03G 15/08* (2006.01)

(52) U.S. Cl.
CPC ..... *G03G 15/0896* (2013.01); *G03G 21/1821* (2013.01); *G03G 21/1825* (2013.01)
USPC ..... 399/111; 399/114

(58) Field of Classification Search
CPC ..... G03G 21/18; G03G 21/1803; G03G 21/1821; G03G 21/1826; G03G 15/0896
USPC ..... 399/110, 111, 113, 114
See application file for complete search history.

(56) References Cited

U.S. PATENT DOCUMENTS

| | | | | |
|---|---|---|---|---|
| 6,070,029 | A * | 5/2000 | Nishiuwatoko et al. | 399/111 |
| 6,101,354 | A | 8/2000 | Nakagawa et al. | |
| 2005/0047822 | A1 | 3/2005 | Hashimoto et al. | |
| 2007/0141889 | A1 | 6/2007 | Chadani et al. | |
| 2009/0003875 | A1 | 1/2009 | Toba et al. | |
| 2010/0040392 | A1 * | 2/2010 | Wu et al. | 399/53 |
| 2011/0311272 | A1 * | 12/2011 | Nittani et al. | 399/111 |

FOREIGN PATENT DOCUMENTS

| | | |
|---|---|---|
| CN | 1444114 | 9/2003 |
| JP | 1999-109742 | 4/1999 |

(Continued)

OTHER PUBLICATIONS

Korean Office Action dated Nov. 27, 2012 issued in KR Application No. 10-2011-0122407.
Chinese Office Action dated Jun. 3, 2014 issued in CN Application No. 201210477810.7.

(Continued)

*Primary Examiner* — David Gray
*Assistant Examiner* — Jessica L Eley
(74) *Attorney, Agent, or Firm* — Staas & Halsey LLP

(57) ABSTRACT

A developing device that attaches/detaches to/from a main body of an image forming apparatus includes a first frame that supports a photosensitive member, a second frame that supports a developing roller, and a connecting bracket in which a fixed supporter couples to a side portion of the first frame, a flexible supporter that couples to a side portion of the second frame, and an elastic arm connecting the fixed supporter and the flexible supporter to each other to provide an elastic force that may elastically bias the developing roller toward the photosensitive member, are integrally formed.

18 Claims, 6 Drawing Sheets

(56) References Cited

FOREIGN PATENT DOCUMENTS

| | | |
|---|---|---|
| JP | 2000-162946 | 6/2000 |
| KR | 10-0500070 | 7/2005 |
| KR | 100584617 | 5/2006 |

OTHER PUBLICATIONS

Extended European Search Report dated Jan. 31, 2014 issued in EP Application No. 12189888.6.

* cited by examiner

DEVELOPING DEVICE AND IMAGE FORMING APPARATUS INCLUDING THE SAME

CROSS-REFERENCE TO RELATED PATENT APPLICATION

This application claims priority under 35 USC §119 from Korean Patent Application No. 10-2011-0122407, filed on Nov. 22, 2011, in the Korean Intellectual Property Office, the disclosure of which is incorporated herein in its entirety by reference.

BACKGROUND

1. Field of the General Inventive Concept

The present general inventive concept relates to a developing device including a developing roller that supplies a toner to a photosensitive member to develop an image and an electrophotographic image forming apparatus adopting the developing device.

2. Description of the Related Art

An electrophotographic image forming apparatus prints images on a recording medium by forming an electrostatic latent image on a surface of a photosensitive member by irradiating a light beam that is modulated according to image information onto the photosensitive member, developing the electrostatic latent image into a visible toner image by supplying a toner onto the electrostatic latent image, and transferring the toner image onto the recording medium to fuse the toner image. The electrophotographic image forming apparatus includes a developing device in which the toner is received.

The toner may be provided as a cartridge including a developing roller, and the cartridge may be referred to as a developing device. When the toner received in the developing device is completely consumed, the developing device is extracted from the image forming apparatus, and a new developing device is mounted in the electrophotographic image forming apparatus.

The developing roller contacts the photosensitive member to have a predetermined nip therebetween, or may be disposed separate from the photosensitive member such that there is a developing gap between the developing roller and the photosensitive member. For a high quality print image without defects, such as a missing or misplaced image, the nip or the developing gap has to be maintained constant. To do this, the developing roller is pressed towards the photosensitive member. If the pressing force is too small, defects, such as the missing or misplaced image, may occur, and if the pressing force is too large, the photosensitive member may be damaged and a driving load of the developing device is increased.

SUMMARY

The present general inventive concept provides a developing device capable of reducing a driving load of the developing device by maintaining a nip or a developing gap between a photosensitive member and a developing roller by using a minimum pressing force, and an electrophotographic image forming apparatus adopting the developing device.

Additional features and utilities of the present general inventive concept will be set forth in part in the description which follows and, in part, will be obvious from the description, or may be learned by practice of the general inventive concept.

An embodiment of the present general inventive concept may be achieved by providing a developing device to attach/detach to/from a main body of an image forming apparatus, the developing device including a first frame that supports a photosensitive member, a second frame that supports a developing roller, and a connecting bracket integrally including a fixed supporter to couple to a side portion of the first frame, a flexible supporter to couple to a side portion of the second frame, and an elastic arm to connect the fixed supporter and the flexible supporter to each other to provide an elastic force and elastically bias the developing roller toward the photosensitive member.

A gap may be formed between the fixed supporter and the flexible supporter, and the elastic arm may connect the fixed supporter and the flexible supporter to each other to generate the elastic force according to variation of the gap. The flexible supporter and the second frame may be coupled to each other so as to elastically deform the elastic arm and to generate the elastic force. The connecting bracket may be formed by a plastic molding process.

A spacer that contacts the photosensitive member to maintain a distance between the developing roller and the photosensitive member may be disposed on a rotary shaft of the developing roller.

The developing device may further include an elastic member supported by the first and second frames to push the second frame in a direction in which the developing roller comes close to the photosensitive member.

A communication unit that is electrically connected to the main body when the developing device is mounted in the main body may be disposed on the connecting bracket.

An embodiment of the present general inventive concept may also be achieved by providing an electrophotographic image forming apparatus to print images on a recording medium including a main body to form a housing of the image forming apparatus, a developing device to attach/detach to/from a main body including a photosensitive member on which an electrostatic latent image is formed and a developing roller to develop the electrostatic latent image as a toner image, an exposure unit to irradiate light onto the photosensitive member to form the electrostatic latent image, and a transfer unit to transfer the toner image to the recording medium, wherein the developing device includes a first frame that supports the photosensitive member, a second frame that supports a developing roller, and a connecting bracket including a fixed support member to couple to the first frame, a flexible support member to couple to the second frame, and an elastic arm to connect the fixed supporter and the flexible supporter to each other to provide an elastic force and elastically bias the developing roller toward the photosensitive member.

The developing device may further include at least one boss may extend from the first frame, and a fixation hole may be disposed in the fixed supporter of the connecting bracket to receive the at least one boss.

The developing device may further include at least one fixation hole connecting part to define the at least one fixation hole, wherein the at least one boss protrudes through at least one the fixation hole to deform and come in contact with a flat portion of the at least one fixation hole connecting part.

The developing device may further include a boss extending from the second frame, and a fixation hole disposed in the flexible supporter of the connecting bracket to receive the boss.

The exposure unit may irradiate light onto a surface of the photosensitive member via an optical path between the first frame and the second frame.

An embodiment of the present general inventive concept may also be achieved by providing a developing device usable with an image forming apparatus including a housing formed with a first frame having a photosensitive roller and a second frame having a developing roller, and a connecting bracket attached to a side of the housing to maintains a distance between the first frame and the second frame.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
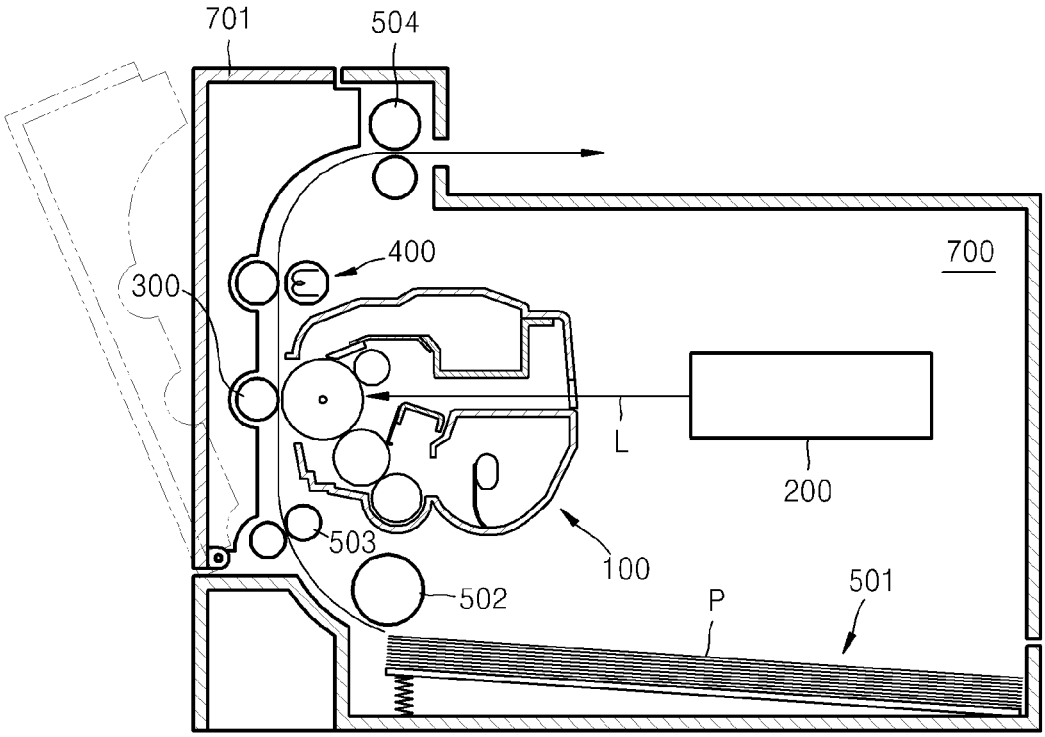
FIG. 1 is a diagram illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
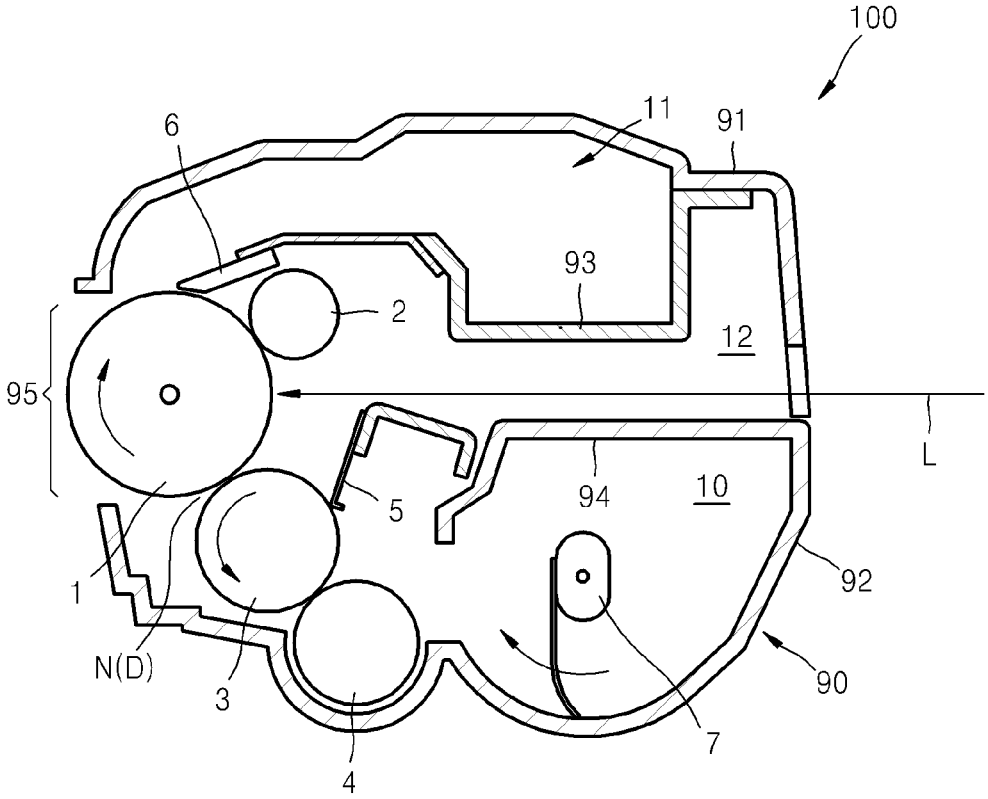
FIG. 2 is a diagram illustrating a developing device adopted in the image forming apparatus of FIG. 1, according to an embodiment of the present general inventive concept.

FIG. 1 is a block diagram illustrating an image forming apparatus according to an embodiment of the present general inventive concept and FIG. 2 is a block diagram illustrating a developing device 100 adopted in the image forming apparatus of FIG. 1, according to an embodiment of the present general inventive concept. The developing device 100 of the present embodiment includes a photosensitive drum 1 and a developing roller 3.

Referring to FIG. 2, the photosensitive drum 1 is an example of a photosensitive member on which an electrostatic latent image is formed and is fabricated by forming a photosensitive layer having a photoconductivity on an outer circumference of a cylindrical metal pipe. A charging roller 2 is an example of a charger that charges a surface of the photosensitive drum 1 to a uniform electric potential. A charging bias voltage is applied to the charging roller 2. A corona charger (not illustrated) may be used instead of the charging roller 2. The developing roller 3 develops the electrostatic latent image formed on the surface of the photosensitive drum 1 by supplying a toner to the electrostatic latent image. When a developing bias voltage is applied to the developing roller 3, toner is transferred from a surface of the developing roller 3 onto the electrostatic latent image formed on the surface of the photosensitive drum 1 and attached.

The developing device 100 may further include a supplying roller 4 to attach the toner on the developing roller 3. A supplying bias voltage may be applied to the supplying roller 4 to attach the toner on the developing roller 3. A regulation member 5 regulates an amount of the toner attached on the surface of the developing roller 3. The regulation member 5 may be, for example, a regulation blade, a leading edge of which contacts the developing roller 3 with a predetermined pressure. A cleaning member 6 removes remaining toner or impurities from the surface of the photosensitive drum 1 before the charging. The cleaning member 6 may be, for example, a cleaning blade, a leading edge of which contacts the surface of the photosensitive drum 1. Hereinafter, the impurities removed from the surface of the photosensitive drum 1 are referred to as waste toner.

The developing device 100 includes a toner receiving unit 10 and a waste toner receiving unit 11. The waste toner receiving unit 11 receives the waste toner that is removed from the surface of the photosensitive drum 1. The toner receiving unit 10 receives and stores the toner to be supplied to the supplying roller 4. An agitator 7 is installed in the toner receiving unit 10. The agitator 7 transfers the toner to the developing roller 3. The agitator 7 may also charge the toner to a predetermined potential by agitating the toner. In FIG. 2, one agitator 7 is illustrated. However, the present general inventive concept is not limited thereto. An appropriate number of agitators 7 may be installed at appropriate locations in the toner receiving unit 10 in order to supply the toner effectively to the developing roller 3 in consideration of a volume or a shape of the toner receiving unit 10. The agitator 7 may be formed by disposing one or more flexible film type agitating wings on a rotary shaft. Although not illustrated in FIGS. 1 and 2, the agitator 7 may be an auger including a spiral agitating wing. The agitator 7 conveys the toner to the developing roller 3, and at the same time, agitates the toner to frictionally charge the toner.

A housing 90 forms the toner receiving unit 10 and the waste toner receiving unit 11 and functions as a frame to support components of the developing device 100, such as the photosensitive drum 1, the charging roller 2, the developing roller 3, the supplying roller 4, and the agitator 7. A part of an outer circumference of the photosensitive drum 1 is exposed from the housing 90 through an opening 95.

The housing 90 may include a first frame 91 and a second frame 92. The first frame 91 supports the photosensitive drum 1, the charging roller 2, and the cleaning member 6, and includes the waste toner receiving unit 11. The second frame 92 supports the developing roller 3, the supplying roller 4, the regulation member 5, and the agitator 7 and includes the toner receiving unit 10. A lower wall 93 of the first frame 91 and an upper wall 94 of the second frame 92 are separated from each other, and an optical path 12 via which light L irradiated from an exposure unit (200 of FIG. 1) is incident to expose the photosensitive drum 1 is formed between the lower wall 93 and the upper wall 94.

Referring to FIG. 1, the developing device 100 is mounted in a main body 700 of the image forming apparatus via a door 701. When the developing device 100 is mounted in the main body 700, a driving unit (not illustrated) disposed in the main body 700 is connected to the developing device 100 to rotate components of the developing device 100, such as the photosensitive drum 1, the charging roller 2, the developing roller 3, the supplying roller 4, and the agitator 7.

The exposure unit 200 irradiates the light L that is modulated according to image information onto the surface of the photosensitive drum 1, which is charged to a uniform potential. A laser scanning unit (LSU) that deflects the light irradiated from a laser diode by using a polygon mirror in a main scanning direction and irradiates the deflected light onto the photosensitive drum 1 may be used as the exposure unit 200.

A transferring roller 300 is an example of a transfer unit that is disposed to face the surface of the photosensitive drum 1 to form a transfer nip. A transferring bias voltage is applied to the transferring roller 300 to transfer a toner image developed on the surface of the photosensitive drum 1 onto a recording medium P. A corona transferring unit may be used instead of the transferring roller 300.

The toner image transferred on a surface of the recording medium P by the transferring roller 300 is maintained on the surface of the recording medium P due to an electrostatic attractive force. A fuser 400 fuses the toner image on the recording medium P by applying heat and pressure onto the toner image to form a permanent print image.

Processes of forming an image using the above-described structure are as follows. A charging bias voltage is applied to the charging roller 2, and the photosensitive drum 1 is charged to a uniform potential. The exposure unit 200 irradiates the light L that is modulated according to the image information onto the photosensitive drum 1 through the optical path 12 in the developing device 100, and thus an electrostatic latent image is formed on the surface of the photosensitive drum 1. The toner is conveyed toward the supplying roller 4 by the agitator 7, and the supplying roller 4 attaches the toner on the surface of the developing roller 3. The regulation member 5 forms a toner layer on the surface of the developing roller 3 to a uniform thickness. A developing bias voltage is applied to the developing roller 3. The toner conveyed to a developing nip N or a developing gap D according to the rotation of the developing roller 3 is attached onto the electrostatic latent image formed on the surface of the photosensitive drum 1 by the developing bias voltage, and a visible toner image is formed on the surface of the photosensitive drum 1. The recording medium P withdrawn from a loading unit 501 by a pickup roller 502 is conveyed by a conveying roller 503 to a transferring nip where the transferring roller 300 and the photosensitive drum 1 face each other. When the transferring bias voltage is applied to the transferring roller 300, the toner image is transferred on the recording medium P by an electrostatic attractive force. When the toner image transferred on the recording medium P is fused on the recording medium P due to heat and pressure applied from the fuser 400, the printing process is finished. The recording medium P is discharged by a discharging roller 504. The toner remaining on the surface of the photosensitive drum 1 is removed by the cleaning member 6 and received by the waste toner receiving unit 11.

Figure 3:
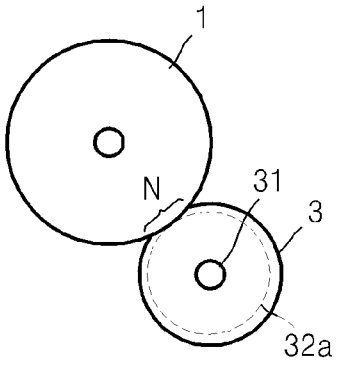
FIG. 3 is a diagram illustrating an example of forming a developing nip by contacting a developing roller to a photosensitive drum according to an embodiment of the present general inventive concept.
Figure 4:
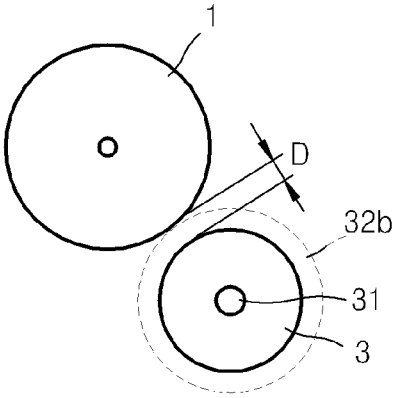
FIG. 4 is a diagram illustrating an example of forming a developing gap by separation of the developing roller from the photosensitive drum according to an embodiment of the present general inventive concept.

FIG. 3 is a diagram illustrating an example of forming a developing nip by contacting a developing roller to a photosensitive drum according to an embodiment of the present general inventive concept. FIG. 4 is a diagram illustrating an example of forming a developing gap by separation of the developing roller from the photosensitive drum according to an embodiment of the present general inventive concept. The developing roller 3 contacts the photosensitive drum 1 to form the developing nip N as illustrated in FIG. 3, or the developing roller 3 may be separated from the photosensitive drum 1 by as much as a developing gap D, as illustrated in FIG. 4. To do this, the developing roller 3 is pressed towards the photosensitive drum 1. To maintain the developing nip N or the developing gap D, a spacer 32*a* or 32*b* is rotatably coupled to a rotary shaft 31 of the developing roller 3. The spacer 32*a* or 32*b* contacts the surface of the photosensitive drum 1 such that the developing roller 3 can be prevented from being excessively close to the photosensitive drum 1 due to the pressing force. Accordingly, the developing nip N or the developing gap D may be maintained.

Figure 5:
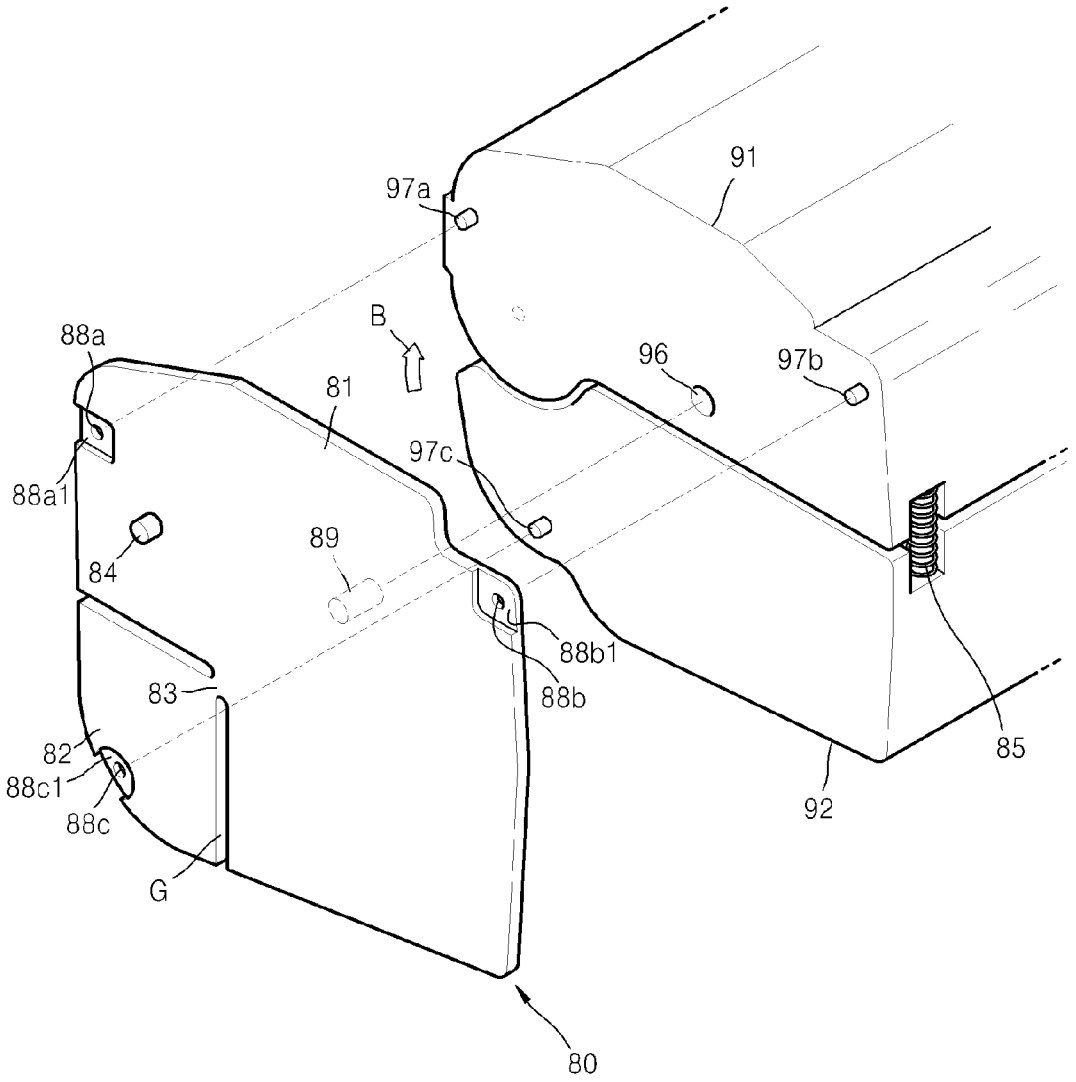
FIG. 5 is an exploded perspective view illustrating an example of a coupling relation between first and second frames and a connecting bracket according to an embodiment of the present general inventive concept.

FIG. 5 is an exploded perspective view illustrating an example of a coupling relation between first and second frames and a connecting bracket according to an embodiment of the present general inventive concept. In order to press the developing roller 3 toward the photosensitive drum 1, the second, or lower, frame 92 may be pushed toward the first, or upper, frame 91. Referring to FIG. 5, a connecting bracket 80 is coupled to side portions of the first and second frames 91 and 92. For example, the connecting bracket 80 includes a hinge shaft 89 that protrudes inward, or toward the first frame 91, and the hinge shaft 89 may be inserted into a hinge hole 96 in the side portion of the first frame 91. In addition, the connecting bracket 80 includes a first fixation hole 88*a*, a second fixation hole 88*b*, and a third fixation hole 88*c*.

The connecting bracket 80 also includes a first fixation hole connecting part 88*a*1, a second fixation hole connecting part 88*b*1 and a third fixation hole connecting part 88*c*1. The first through third fixation hole connecting parts 88*a*1, 88*b*1 and 88*c*1 surround and define the first through third fixation holes 88*a*, 88*b* and 88*c*. The first through third fixation hole connecting parts 88*a*1, 88*b*1 and 88*c*1 may include a flat portion that surrounds the fixation holes and is indented from an outer surface of the connecting bracket 80 that faces away from the first frame 91 and the second frame 92. A side of the connecting bracket 80 and of the first through third fixation hole connecting parts 88*a*1, 88*b*1 and 88*c*1 that faces towards the first frame 91 and second frame 92 may be flat and flush with the first frame 91 and second frame 92 when connected thereto.

The first frame 91 includes a first fixation boss 97*a* and a second fixation boss 97*b* disposed thereon. The second frame 92 includes a third fixation boss 97*c* disposed thereon. The first through third fixation bosses 97*a*, 97*b* and 97*c* may be inserted into the first through third fixation holes 88*a*, 88*b*, and 88*c*, respectively. When the first through third fixation bosses 97*a*, 97*b*, and 97*c* are inserted into the first through third fixation holes 88*a*, 88*b*, and 88*c*, respectively, upper, or outer, portions of the first through third bosses 97*a*, 97*b*, and 97*c* may protrude from, or through, the connecting bracket 80.

Figure 6:
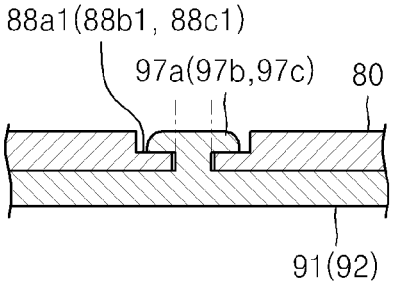
FIG. 6 is a cross-sectional view illustrating a coupling between the connecting bracket and the first and second frames by a heat welding method according to an embodiment of the present general inventive concept.

FIG. 6 is a cross-sectional view illustrating a coupling between the connecting bracket and the first and second frames by a heat welding method according to an embodiment of the present general inventive concept. Referring to FIG. 6, the protruding parts of the first through third fixation bosses 97*a*, 97*b*, and 97*c* are deformed to come in contact with the first through third fixation hole connecting parts 88*a*1, 88*b*1 and 88*c*1 as denoted by solid lines illustrated in FIG. 6 through a thermal welding method, and thus, the connecting bracket 80 may be coupled to the side portions of the first and second frames 91 and 92. A method of coupling the connecting bracket 80 to the first and second frames 91 and 92 is not limited to the above example, and, for example, the connecting bracket 80 may be coupled to the first and second frames 91 and 92 by using a coupling member, such as a screw.

As illustrated in FIG. 6, the first through third bosses 97*a*, 97*b*, and 97*c* are formed integrally, or continuously with the first and second frames 91 and 92. Thus, the first and second frames 91 and 92 and the first through third bosses 97*a*, 97*b*, and 97*c* may all be formed of a single continuous piece of material. Alternatively, the first through third bosses 97*a*, 97*b* and 97*c* may be separately formed from the first and second frames 91 and 92, and separately welded to the first and second frames 91 and 92.

Figure 7:
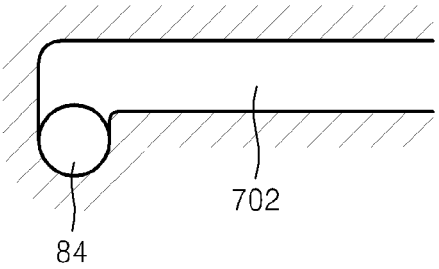
FIG. 7 is a diagram illustrating a state of determining a location of the developing device by a location determining boss and a location determining guide according to an embodiment of the present general inventive concept.

FIG. 7 is a diagram illustrating a state of determining a location of the developing device by a location determining boss and a location determining guide according to an embodiment of the present general inventive concept. The connecting bracket 80 may include a location determining boss 84 to determine a location of the developing device 100 when the developing device 100 is mounted in the main body 700. As illustrated in FIG. 7, the location determining boss 84 is guided by a location determining guide, or slot, 702 formed on the main body 700 so that the developing device 100 may be located, or positioned, at a desired position in the main body 700. The location determining boss 84 may be coaxially formed with the rotary shaft of the photosensitive drum 1.

Referring to FIG. 5, the connecting bracket 80 may include a fixed supporter 81 and a flexible supporter 82. The fixed supporter 81 and the flexible supporter 82 are separated from each other by a predetermined gap G. The fixed supporter 81 and the flexible supporter 82 are connected to each other by an elastic arm 83. The elastic arm 83 connects the fixed supporter 81 and the flexible supporter 82 to each other across the gap G. The elastic arm 83 may extend from the hinge shaft 89. That is, the hinge shaft 89 may operate as a rotational center to rotate the second frame 92 with respect to the first frame 91. The elastic arm 83 provides the second frame 92 with an elastic force such that the developing roller 3 may be elastically biased toward the photosensitive drum 1. The elastic arm 83 generates the elastic force to correspond to the variation of the gap G. When the flexible supporter 82 is coupled to the second frame 92, the flexible supporter 82 is coupled to the second frame 92 so as to elastically deform the elastic arm 83 as denoted by the short-short-long dashed lines illustrated in FIG. 8.

Figure 8:
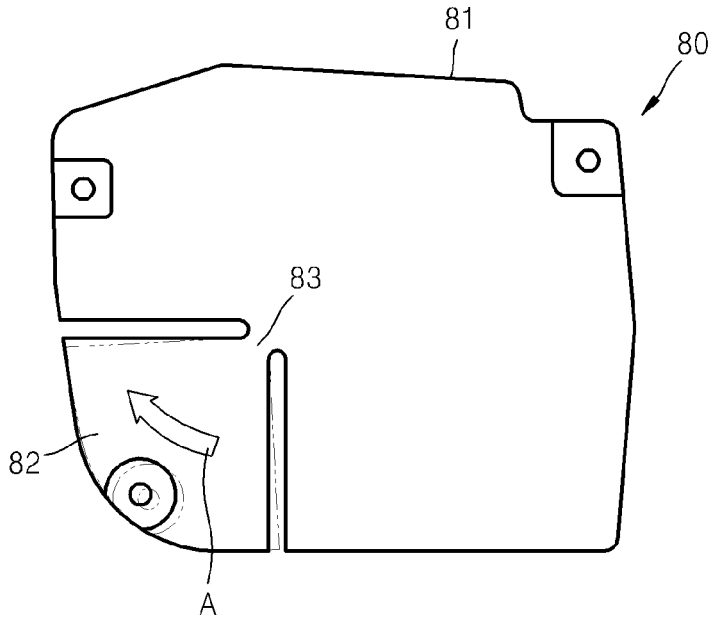
FIG. 8 is a side view illustrating a transformed state of a flexible supporter according to an embodiment of the present general inventive concept.

FIG. 8 is a side view illustrating a transformed state of a flexible supporter according to an embodiment of the present general inventive concept. Referring to FIGS. 5, 6 and 8, when the third fixation boss 97*c* of the second frame 92 is inserted into the fixation hole 88*c* to couple with the third fixation hole connecting part 88*c*1, the flexible supporter 82 of the connecting bracket 80 is changed from a free state denoted by the solid lines in FIG. 8 into a biased state denoted by the short-short-long dashed lines in FIG. 8. Since the elastic arm 83 tends to return to the original state, an elastic force is applied to the second frame 92 coupled to the flexible supporter 82 such that the second frame 92 rotates in a direction denoted by the arrow A in FIG. 8. Due to the elastic force, the developing roller 3 is pressed towards the photosensitive drum 1, and the spacer 32*a* or 32*b* contacts the outer circumference of the photosensitive drum 1 to maintain the developing nip N or the developing gap D. The connecting bracket 80 may be formed by a plastic molding method. The connecting bracket 80 may be formed of, for example, acrylonitrile butadiene styrene copolymer (ABS) resin, polystyrene (PS) resin, high impact polystyrene (HIPS) resin, or polycarbonate (PC) resin.

To provide a pressing force to press the developing roller 3 toward on the photosensitive drum 1, a compression coil spring (not illustrated) may be used. The pressing force may be determined such that a missing or misplaced image does not occur during the development. Assuming that a minimum value of the pressing force that does not cause the misplaced image is F1, an error of a spring force of the compression spring force needs to be considered when designing the compression coil spring. In general, the error of the spring force of the compression coil spring ranges about ±10~15%, and thus, the compression coil spring has to be designed so that the lowest value of the spring force is the minimum value F1 of the pressing force in consideration of the error of the spring force, in order to prevent the misplaced image from occurring. That is, a designed spring force F2 of the compression coil spring may be determined by the equation $F2=F1/(0.85\sim0.9)$.

In this case, the maximum value F3 of the actual spring force is determined by the equation $F3=F2\times(1.1\sim1.15)=\{F1/(0.85\sim0.9)\}\times(1.1\sim1.15)$.

That is, the maximum value F3 of the actual spring force may be about 1.29 to about 1.35 times greater than the minimum value F1 that does not cause the misplaced image. A driving motor (not illustrated) to drive the developing device 100 has to be selected in consideration of a driving load caused by the maximum value F3 of the actual spring force.

As described above, when the compression coil spring is used, the driving motor has to be selected in consideration of the spring force that is greater than the minimum pressing force by about 30% due to the error of the spring force, and thus the cost of the motor may be increased. Since an amount of electric current consumed by the driving motor also increases, components of a driving circuit to drive the motor are high-priced components having a large continuous power. In addition, the photosensitive layer on the surface of the photosensitive drum 1 may be damaged due to the spacer 32*a* or 32*b* that contacts the photosensitive drum 1, due to an excessive pressing force, and thus, defects in an image may occur.

According to the developing device 100 of the present embodiment, the pressing force is provided by the elastic deformation of the elastic arm 83 of the connecting bracket 80, which connects the first and second frames 91 and 92. A elastic deformed amount of the elastic arm 83 depends upon a dimensional accuracy of the connecting bracket 80. For example, it is assumed that the gap G is about 1.5 mm and the elastic arm 83 is designed to obtain a pressing force of about 300 grams-force (gf) when the flexible supporter 82 is deviated about 1.5 mm, as denoted by the dashed line in FIG. 8. In the plastic molding method, the dimensional error of the gap G may be managed within a range of about ±0.05 mm. Therefore, a deviation of the pressing force is about $\pm(0.05/1.5)\times100\%$, and thus, a difference between the maximum value and the minimum value is about 20 gf, which is greater than the designed value by about 6.7%. Therefore, according to the developing device 100 of the present embodiment, a load torque applied to the driving motor may be reduced less than that when the coil spring is used, and accordingly, a cheap motor having a small continuous power may be used as the driving motor. In addition, the possibility of damaging the photosensitive layer of the photosensitive drum 1 due to the spacer 32*a* or 32*b* may be reduced. That is, a mold spring having a small error range is used as the elastic member to provide the pressing force, and thus, the driving load applied on the developing device 100 may be reduced. In addition, the mold spring is integrally formed with the connecting bracket 80 that is disposed on the side portion of the developing device 100, and the number of components and costs may be reduced.

Referring to FIG. 5, an elastic member 85 may be further provided in order to press the developing roller 3 toward the photosensitive drum 1. The elastic member 85 may be a compression coil spring supported by the first and second frames 91 and 92. The second frame 92 is pressed in a rotation direction with respect to the first frame 91 about the hinge shaft 89 due to the elastic force of the elastic member 85, as denoted by the arrow B. The elastic member 85 may be an extension coil spring, and in this case, the elastic member 85 may be located at an appropriate position where the elastic force may be applied to the second frame 92 so that the second frame 92 may rotate in the direction denoted by the arrow B.

As described above, by using both the elastic arm 83 of the connecting bracket 80 and the elastic member 85, the elastic member 85 of a coil spring type may provide only a part of the pressing force. Accordingly, the pressing force of the coil spring, the spring force of which has a large error range, may be reduced, and the increase in the driving load of the developing device 100 due to the error of the spring force may be reduced.

Figure 9:
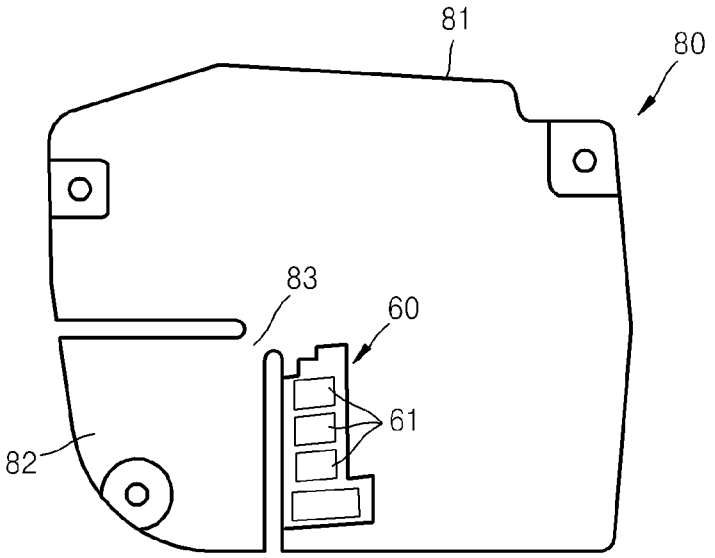
FIG. 9 is a side view illustrating a communication unit disposed on the connecting bracket according to an embodiment of the present general inventive concept.

FIG. 9 is a side view illustrating a communication unit disposed on the connecting bracket according to an embodiment of the present general inventive concept. Referring to FIG. 9, a communication unit 60 may be included in the developing device 100. The communication unit 60 may be provided in, for example, the connecting bracket 80. The communication unit 60 is electrically connected to the main body 700 of the image forming apparatus to transmit information of the developing device 100 to the main body 700. For example, the communication unit 60 may be a circuit board including a memory (not illustrated) in which information such as a model name of the developing device 100 is stored, and a plurality of electrical-contact units 61 to electrically connect to the main body 700. A plurality of spring contacts (not illustrated) that electrically connect to the electrical contact units 61 may be disposed in the main body 700 of the image forming apparatus. As described above, by disposing the communication unit 60 on the connecting bracket 80, additional components to dispose the communication unit 60 are unnecessary, and thus, costs for these components may be excluded.

While mounting the developing device 100 in the main body 700, the spring contacts (not illustrated) may contact the connecting bracket 80, which may wear the connecting bracket 80. Therefore, the connecting bracket 80 may be formed of a PC resin having excellent abrasion-resistance properties.

In the above embodiment, the image forming apparatus of a single-color including one developing device 100 is described. However, the present general inventive concept is not limited thereto. In a full-color image forming apparatus, four developing devices including toners of cyan (C), magenta (M), yellow (Y), and black (K) colors may be used.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing device to attach/detach to/from a main body of an image forming apparatus, the developing device comprising:

a first frame that supports a photosensitive member;

a second frame that supports a developing roller; and a connecting bracket integrally including a fixed supporter to couple to a side portion of the first frame, a flexible supporter to couple to a side portion of the second frame, and an elastic arm to connect the fixed supporter and the flexible supporter to each other to provide an elastic force and elastically bias the developing roller toward the photosensitive member.

2. The developing device of claim 1, wherein a gap is formed between the fixed supporter and the flexible supporter, and the elastic arm connects the fixed supporter and the flexible supporter to each other to generate the elastic force according to variation of the gap.

3. The developing device of claim 2, wherein the flexible supporter and the second frame are coupled to each other so as to elastically deform the elastic arm and to generate the elastic force.

4. The developing device of claim 3, wherein the connecting bracket is formed by a plastic molding process.

5. The developing device of claim 1, further comprising a spacer disposed on a rotary shaft of the developing roller to contact the photosensitive member and maintain a distance between the developing roller and the photosensitive member.

6. The developing device of claim 1, further comprising an elastic member supported by the first and second frames to push the second frame in a direction in which the developing roller comes close to the photosensitive member.

7. The developing device of claim 1, further comprising a communication unit disposed on the connecting bracket to electrically connect to the main body when the developing device is mounted in the main body.

8. The developing device of claim 1, further comprising:

a boss extending from the second frame; and a fixation hole disposed in the flexible supporter of the connecting bracket to receive the boss.

9. An electrophotographic image forming apparatus to print images on a recording medium comprising:

a main body to form a housing of the image forming apparatus;

a developing device to attach/detach to/from a main body, the developing device comprising a photosensitive member on which an electrostatic latent image is formed and a developing roller to develop the electrostatic latent image as a toner image;

an exposure unit to irradiate light onto the photosensitive member to form the electrostatic latent image;

a transfer unit to transfer the toner image to the recording medium, wherein the developing device further comprises:

a first frame that supports the photosensitive member;

a second frame that supports the developing roller; and a connecting bracket including a fixed support member to couple to the first frame, a flexible support member to couple to the second frame, and an elastic arm to connect the fixed supporter and the flexible supporter to each other to provide an elastic force and elastically bias the developing roller toward the photosensitive member.

10. The electrophotographic image forming apparatus of claim 9, wherein a gap is formed between the fixed supporter and the flexible supporter, and the elastic arm connects the fixed supporter and the flexible supporter to each other to generate the elastic force according to variation of the gap.

11. The electrophotographic image forming apparatus of claim 9, wherein the flexible supporter and the second frame are coupled to each other so as to elastically deform the elastic arm and to generate the elastic force.

12. The electrophotographic image forming apparatus of claim 9, wherein the connecting bracket is formed by a plastic molding process.

13. The electrophotographic image forming apparatus of claim 9, wherein a spacer that contacts the photosensitive member to maintain a distance between the developing roller and the photosensitive member is disposed on a rotary shaft of the developing roller.

14. The electrophotographic image forming apparatus of claim 9, further comprising an elastic member supported by the first and second frames to push the second frame in a direction in which the developing roller comes close to the photosensitive member.

15. The electrophotographic image forming apparatus of claim 9, further comprising a communication unit disposed on the connecting bracket that is electrically connected to the main body when the developing device is mounted in the main body.

16. The developing device of claim 1, further comprising:

at least one boss extending from the first frame; and a fixation hole disposed in the fixed supporter of the connecting bracket to receive the at least one boss.

17. The developing device of claim 16, further comprising:

at least one fixation hole connecting part to define the at least one fixation hole, wherein the at least one boss protrudes through at least one the fixation hole to deform and come in contact with a flat portion of the at least one fixation hole connecting part.

18. The electrophotographic image forming apparatus of claim 9, wherein the exposure unit irradiates light onto a surface of the photosensitive member via an optical path between the first frame and the second frame.

* * * * *